United States Patent [19]

Ubukata et al.

[11] Patent Number: 4,517,541

[45] Date of Patent: May 14, 1985

[54] SNAP TYPE THERMALLY RESPONSIVE SWITCH DEVICE

[75] Inventors: Susumu Ubukata; Yasukazu Mizutani; Shozo Iyoda, all of Nagoya, Japan

[73] Assignee: Susumu Ubukata, Nagoya, Japan

[21] Appl. No.: 550,182

[22] Filed: Nov. 9, 1983

[30] Foreign Application Priority Data

Nov. 24, 1982 [JP] Japan ..... 57-177393[U]

[51] Int. Cl.[3] ..... H01H 61/00; H01H 37/04

[52] U.S. Cl. ..... 337/89; 337/343; 337/372

[58] Field of Search ..... 337/89, 94, 53, 57, 337/343, 347, 365, 368, 372, 380

[56] References Cited

U.S. PATENT DOCUMENTS 3,546,652 12/1970 Allen et al. ..... 337/347

3,577,111 5/1971 Nardulli ..... 337/372

*Primary Examiner*—Harold Broome

*Attorney, Agent, or Firm*—Steele, Gould & Fried

[57] ABSTRACT

A thermally responsive switch device includes; a bimetallic plate enclosed within a metallic enclosure in a cantilever manner and having a central dish-shaped portion for snap movement. The bimetallic plate carries a movable contact at one free end to be in making contact relationship with a fixed contact which is placed into the enclosure. A calibrator projection is provided with the enclosure to engage with the dish-shaped portion to exert point pressure between the contacts. A reinforcer extension is disposed in the enclosure and has one end secured to the inner side of the enclosure and its other end sandwiching the dish-shaped portion in cooperation with the projection so as to prevent the cantilever support end of the plate from being deformed irrespective of often repeated snap actions of the plate in response to the ambient temperature or the like.

8 Claims, 3 Drawing Figures

SNAP TYPE THERMALLY RESPONSIVE SWITCH DEVICE

BACKGROUND OF THE INVENTION (1) Field of the Art

This invention relates to a switch device comprising a thermally responsive element such as bi- or tri-metallic disc cantilever supported within a metallic enclosure in a manner to have a movable contact at its free end in making and breaking contact relationship with a fixed contact secured to a suitable support arm, and more particularly concerns a thermally responsive switch device having a central dish-shaped portion to cause the thermally responsive element to reverse its curvature with snap action in response to the ambient temperature or the like.

(2) Description of the Prior Art

In this type of a thermally responsive switch, a projection depends from the upper inner side of the enclosure to engage with the upwardly curved dish-shaped portion of the thermally responsive disc to exert a pressure from the movable contact to the fixed contact in order to eliminate initial creep from the disc upon its hot and cold snap movement according to elevated and lowered temperature.

However, such movement always accompanied by welding force, albeit slightly, due to arching between the movable and the fixed contacts, subjecting the disc to reaction of the welding force at the proximity of the cantilever end. The reaction tube exerted upon the disc allows bending moment about its cantilever support end to result in its increased deformation.

One of the problems arising from the above is to render the hot and cold snap temperatures in variance from intended ones, otherwise to allow the disc for creep so as to deteriorate its endurance.

SUMMARY OF THE INVENTION

It is therefore a primary object of the present invention to provide a thermally responsive switch device which will be particularly effective in obviating the above drawbacks of the prior art device.

It is an object of the invention to provide a thermally responsive switch device which is capable of preventing a thermally responsive element from being deformed at its cantilever support end, and therefore maintaining intended hot and cold snap temperature, at the same time, eliminating creep from the thermally responsive element when it snaps in response to the ambient temperature or the like.

It is another object of the invention to provide a thermally responsive switch device which allows a thermally responsive element for minimum snap temperature deviation among manufactured products.

It is still another object of the invention to provide a thermally responsive switch device of which structure is such that the electric current flow through a thermally responsive element to make it snap is readily and conveniently determined.

According to the present invention, there is provided a switch device comprising a reinforcer extension to prevent a thermally responsive element from being deformed at the proximity of the cantilever support end. The reinforcer extension thus introduced has one end rigidly secured to a stationary member in the neighborhood of the cantilever support end of the thermally responsive element, and its other end disposed in a manner to sandwich a central dish-shaped portion of the element in cooperation with a temperature calibration projection. Whereby allowing bending moment working to the thermally responsive element to be partly shared by its dish-shaped portion of relatively high rigidity so as to effectively prevent the cantilever support end from being deformed.

According to the present invention, there is also provided a thermally responsive switch device having a member to cantilever support a thermally responsive element, and an integral temperature calibration projection in a metallic enclosure forming an outer shell of the device, thereby allowing minimum snap temperature deviation among products.

According to the present invention, there is provided a thermally responsive switch device of which structure is such that an electrically conductive support arm carrying a fixed contact at one end is supported through a spacer by a metallic enclosure, whereby allowing the support arm to be substantially free from its strength restraint, thus permitting the support arm for wider varieties of electrical resistances that is, extensive selection of Joule heat generation to which a thermally responsive element is subjected.

The above and other objects, features and advantages of the present invention will become apparent from the following description and the appended claims, taken in conjunction with the accompanying drawings which shows by way of example preferred embodiments of the present invention and in which like component parts are designated by like reference numerals throughout the various figures.

BRIEF DESCRIPTION OF DRAWINGS

In the accompanying drawings.

DETAILED DESCRIPTION OF PREFERRED EMBODIMENT

Figure 1:
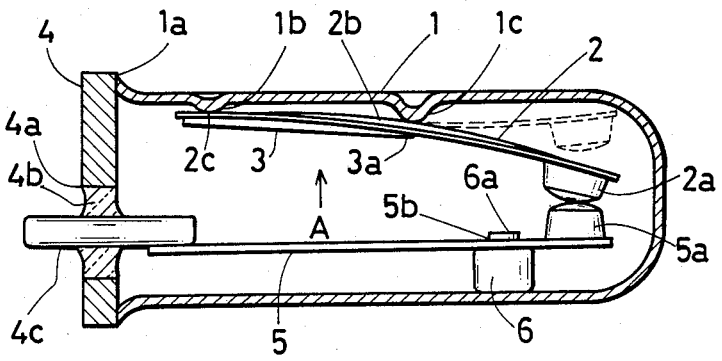
FIG. 1 is a side elevational view of a thermally responsive switch device with both its enclosure and lid plate partly broke away.

Referring to the drawings, a metallic enclosure designated at 1 is rectangular in cross section and having an opening 1*a* at one end. At the upper inner side of the enclosure 1 are first and second projections integrally provided by deforming the enclosure inward with a certain lengthwise distance presenting therebetween. To the first projection 1*b*, which is determined shorter than the second one 1*c*, is connected one end of a thermally responsive disc 2 such as bi- or tri-metallic disc secured by means of welding or the like. With the second projection 1*c* is an upwardly oriented central dish-shaped portion 2*b* of the disc which is brought into engagement to provide a certain point pressure therebetween.

It is noted that the first projection 1*b* may be of zero length unless it influences the snap movement of the disc 2.

A reinforcer extension designated at 3, which is of metallic material such as, for example, iron metal and having thickness similar to/or larger than that of the disc 2, has one end secured to the first projection 1*b* by means of spot welding or the like with the end portion 2c of the disc 2 sandwiched between the projection 1b and the secured end of the reinforcer extension.

In this instance, the reinforcer extension 3 is reduced at its width so as to make it immune to the snap temperature since the extension 3 has one end 3a position in the neighborhood of the inner side of the dish-shaped portion 2b presenting upward oriented curvature at the normal temperature to sandwich the central point of the portion 2b in cooperation with the second projection 1c.

Such is the construction that the disc 2 is allowed to slide between the end portion 3a of the reinforcer extension 3 and the apex of the projection 1c therealong when the disc 2 snaps from the position of FIG. 1 in which a movable contact 2a and a fixed contact 5a both later described are making contact each other to the position of FIG. 2 in which the above members are breaking contact with each other, and viceversa.

Meanwhile, to the free end of the disc 2 is secured the movable contact 2a which is made from silver-based material for example. A lid plate 4, which is made from a stamped sheet metal of relatively great thickness, has a central aperture 4a into which an electrical conductor piece 4c is rigidly inserted via an electrically insulated filler 4b such as, for example, a glass sealant. The conductor piece 4c has one end extended into the enclosure 1 to carry an elongated metallic support arm 5 by means of welding or the like. The support arm 5 carries the fixed contact 5a made from material such as, for example, silver-based material which is connected on the opposite end to the conductor piece 4c.

In the neighborhood of the fixed contact 5a is a small aperture 5b provided in the arm 5. Into the aperture 5b is inserted the diameter-reduced portion 6a of a stepped cylindrical spacer 6 which is made from material such as, for example, ceramic material. The spacer 6 is substantially secured to the enclosure 1 by being located between the arm 5 and the inner side of the enclosure 1 with the elastic force exercising from the arm to the spacer.

Figure 2:
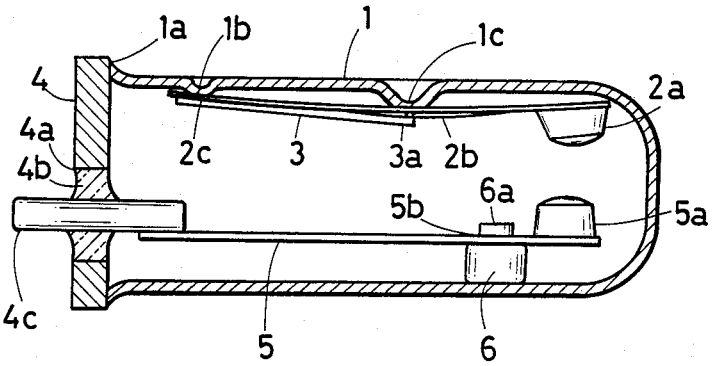
FIG. 2 is a view similar to FIG. 1 except for the position of a thermally responsive element.
Figure 3:
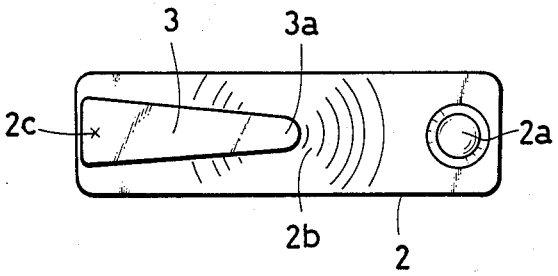
FIG. 3 is a plan view looking from arrow A of FIG. 1 to show both a thermally responsive element and a reinforcer extension.

In so doing, upon calibrating the snap temperature of the disc 2 after closing the opening 1a by the lid plate 4, on the assumption that the disc reverses with snap action from its upward oriented curvature of solid lined position in FIG. 1 to the downward oriented curvature of broken lined position at the temperature, say 150° C. with no point pressure exerting between the contacts 2a and 5a, it is well-known that gradual increase of the point pressure allows the hot snap temperature to be adjusted to 145° C. or 140° C.

This is accomplished with external manipulation and with ease by deforming the enclosure 1 in a crosswise space-reducing direction in such a manner that the projection 1c pushes the disc 2 to impress point pressure between the contacts 2a and 5a.

From the foregoing description, the following advantages are apparently obtained.

The bending moment resulted from the disc 2 hot snapping by overcoming the welding force between the contacts, is shared by the support end 2c and the central point of the dish-shaped portion 2b so as to substantially make the portion around the support end 2c free from deformation. This is the same case with the dish-shaped portion 2b which is of high rigidity accrued from its own configuration.

This ensures that the predetermined hot and cold snap temperatures are maintained for a long period of time, and at the same time, eliminates initial creep of the disc.

As an example, take a rectangular bimetallic plate with its corners rounded which is stamped and drawn from an iron sheet to measure 13 mm in length and 5 mm in width, and adapted to hot snap at the temperature, say 145° C. and cold snap at the temperature, say 90° C. The plate thus mentioned above, unless equipped with a reinforcer extension, is attendant with bending deformation at the proximity of the support end to render the cold snap temperature at variance from the predetermined temperature, and accompanies by creep at the repeated snap times of 4,000 in opposition to the one which normally repeats to snap more than 30,000 times with the reinforcer extension equipped.

In general including the present invention, the construction is such that energizing across the conductor piece 4c and the lid plate 4, if the current thereacross exceeds the predetermined level, it will allow the disc 2 to be heated by its Joule heat generation so as to snap the disc for breaking contact between the contacts 5a and 2a. In an instance in which it is necessary to accommodate minimum current, that is ultimate trip current (referred to as U.T.C hereinafter) with rating current of such as, for example, an electric motor to be protected, one problem that arises is that the combining of bimetallic plates of different electrical resistances alone allows for small selection degree of U.T.C. This is the same case with combining trimetallic plates.

However, the support arm 5, albeit cantilever supported, is also supported by the spacer 6 at the end in the proximity of the fixed contact 5a, so that the arm is substantially of high rigidity sufficient to maintain the arm in cantilever supported configuration. This eliminates a need of considering strength involving the arm 5, contrary to the one which is of cantilever construction pure and simple, so the U.T.C is determined from wider varieties of cross sections, lengths and inherent electrical resistances of the arm, thus allowing for extensive selection degree of U.T.C, that is extensive degree of Joule heat selection for the disc.

Yet further, the hot and cold snap temperatures of the disc 2 are also susceptible to change depending upon the relative position of the projection 1c toward the support end 2c supported by the projection 1b.

In this instance, both projections 1b and 1c are integral with the enclosure 1 so as to minimize the dimensional deviation of distances between the projections 1b and 1c among manufactured products, contrary to a design in which projections are discrete members each other. This is conducive to maintaining minimum deviation of the hot and cold snap temperatures among manufactured products.

In addition, the present construction requires relatively few parts and the part components can be of simplified construction since the disc is substantially directly secured to the enclosure 1 instead of securing it through an intermediate member.

While the form of the invention now preferred has been disclosed as required by statute, other forms may be used, all coming within the scope of the claimed subject matter which follows:

What is claimed is:

1. A snap type thermally responsive switch device comprising:

(a) a thermally responsive element having a central dish-shaped portion to induce snap movement, the element being enclosed within a metallic enclosure in a manner to have one end secured to a stationary means so as to act as a support end, and the other end carrying a movable contact in making contact relationship with a fixed contact at the normal temperature which is disposed in said enclosure;

(b) a first projection in the enclosure disposed to always engage the central portion of said dish-shaped portion;

(c) a reinforcer extension having one end secured to said stationary means in the proximity of the support end of said thermally responsive element, and the other end sandwiching the central portion of said dish-shaped area in cooperation with said first projection, the reinforcer extension being adapted to allow said dish-shaped area to slide between said other end and said projection.

2. The thermally responsive switch device as recited in claim 1, wherein both said stationary means and said porjection are provided by deforming a wall of said enclosure toward the center thereof.

3. A thermally responsive switch device comprising;

(a) a metallic enclosure having one end open and other end closed;

(b) a lid plate disposed to close the open end of said enclosure;

(c) an electrically conductive elongated support extension disposed in said enclosure the support extension having one end supported by said lid plate, the other end carrying a fixed contact;

(d) An electrically insulated spacer in contact with the elongated support extension to allow said support extension to be supported by said enclosure at the proximity of said fixed contact;

(e) a thermally responsive element within the enclosure, the element having two ends and having a central dish-shaped portion to induce snap movement, one end of the element being secured to a stationary means so as to act as a support end, and the other end carrying a movable contact in making contact relationship with the fixed contact at the normal temperature which is disposed in said enclosure;

(f) a projection in the enclosure disposed to always engage the substantially central portion of said dish-shaped area; and (g) a reinforcer extension having one end secured to said stationary means at the proximity of the support end of said thermally responsive element, and its other end sandwiching the substantially central portion of said dish-shaped area in cooperation with said projection, while allowing said dish-shaped area to slide between said other end and said projection.

4. The thermally responsive switch device of claim 1 wherein the dish-shaped portion is convex-shaped at the said normal temperature and is concave-shaped at an elevated temperature, and wherein the dish-shaped portion is always contacted by and sandwiched between the said projection and said other end of the reinforcer extension.

5. The thermally responsive switch device of claim 4 and an electrically conductive elongated support carried in electrically insulated relationship by the enclosure, the elongated support positioning the fixed contact in a location to be contacted by the movable contact when the dish-shaped portion is concave-shaped.

6. The thermally responsive switch device of claim 5 and a spacer intermediate the elongated support and the enclosure to enhance the rigidity of the elongated support.

7. The thermally responsive switch device of claim 1 wherein the stationary arms comprises an inward second projection in the metallic enclosure.

8. The thermally responsive switch device of claim 7 wherein the second projection and the first projection are spaced from each other by a distance that is substantially one-half the length of the thermally responsive element.

* * * * *